US011135702B2

(12) United States Patent
Su

(10) Patent No.: US 11,135,702 B2
(45) Date of Patent: Oct. 5, 2021

(54) TOOL ADAPTED TO BE DRIVEN RAPIDLY

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 316 days.

(21) Appl. No.: 16/282,415

(22) Filed: Feb. 22, 2019

(65) Prior Publication Data

US 2020/0030944 A1 Jan. 30, 2020

(30) Foreign Application Priority Data

Jul. 30, 2018 (TW) ..... 107126259

(51) Int. Cl.

| | |
|---|---|
| ***B25B 7/02*** | (2006.01) |
| ***B25B 7/10*** | (2006.01) |
| ***B25B 13/14*** | (2006.01) |
| ***B25B 13/08*** | (2006.01) |

(52) U.S. Cl.

CPC ..... *B25B 7/02* (2013.01); *B25B 7/10* (2013.01); *B25B 13/08* (2013.01); *B25B 13/14* (2013.01)

(58) Field of Classification Search

CPC .. B25B 7/02; B25B 7/10; B25B 13/08; B25B 13/14; B25B 13/48

USPC ..... D8/21, 27, 28

See application file for complete search history.

(56) References Cited

U.S. PATENT DOCUMENTS

| | | | | | |
|---|---|---|---|---|---|
| 914,199 | A | * | 3/1909 | Stiren | B25D 1/02 7/138 |
| 3,620,107 | A | * | 11/1971 | Evans | B25B 13/46 81/125.1 |
| 3,695,125 | A | * | 10/1972 | Glass | B25B 13/08 81/179 |
| 3,762,244 | A | * | 10/1973 | Evans | B25B 13/46 81/119 |
| 3,881,377 | A | * | 5/1975 | Evans | B25B 13/46 81/186 |
| 4,889,020 | A | | 12/1989 | Baker | |
| 5,406,868 | A | | 4/1995 | Foster | |
| 5,878,636 | A | | 3/1999 | Baker | |
| 5,992,271 | A | | 11/1999 | Mehlau et al. | |
| D431,764 | S | * | 10/2000 | Pai | D8/28 |

(Continued)

FOREIGN PATENT DOCUMENTS

| | | |
|---|---|---|
| TW | 293299 | 12/1996 |
| TW | M549186 U | 8/2003 |

(Continued)

*Primary Examiner* — David B. Thomas

(74) *Attorney, Agent, or Firm* — Alan D. Kamrath; Karin L. Williams; Mayer & Williams PC

(57) ABSTRACT

A tool adapted to be driven rapidly includes a driving portion which has a first jaw and a second jaw and an opening between the first and the second jaws configured to receive an object to be driven. The first and the second jaws have first and second engaging sides configured to grip the object to be driven. The opening has a closed end, an open end, and two opposite sides respectively delimited by the first and the second engaging sides. The first engaging side extends along a linear line. The second engaging side extends along a curved line. The closed end of the opening has a smaller width than the open end of the opening.

13 Claims, 15 Drawing Sheets

(56) References Cited

U.S. PATENT DOCUMENTS

| | | | | |
|---|---|---|---|---|
| 6,155,141 | A | 12/2000 | Baker | |
| 6,158,309 | A * | 12/2000 | Baker | B25B 13/08 81/119 |
| 6,240,812 | B1 | 6/2001 | Baker | |
| 6,289,772 | B1 * | 9/2001 | Ying-Wen | B25B 13/08 81/119 |
| 6,637,300 | B2 * | 10/2003 | Wu | B25B 13/14 81/170 |
| 6,739,223 | B2 * | 5/2004 | Wu | B25B 13/12 81/165 |
| 6,848,343 | B2 * | 2/2005 | Wu | B25B 13/08 81/170 |
| 7,044,033 | B2 * | 5/2006 | Hirse | B25B 7/02 81/385 |
| 2013/0192428 | A1 * | 8/2013 | Chen | B25B 13/08 81/119 |

FOREIGN PATENT DOCUMENTS

| | | | |
|---|---|---|---|
| TW | M289365 | U | 4/2006 |
| TW | M320941 | U | 10/2007 |
| TW | M382177 | U | 6/2010 |
| TW | M434647 | U | 8/2012 |
| TW | M439545 | U | 10/2012 |
| TW | M483145 | U | 8/2014 |
| TW | I460054 | B | 11/2014 |
| TW | M507331 | U | 8/2015 |
| TW | M513095 | U | 12/2015 |
| TW | M532341 | U | 11/2016 |

* cited by examiner

TOOL ADAPTED TO BE DRIVEN RAPIDLY

BACKGROUND OF THE INVENTION

1. Field of the Invention

The present invention relates to a tool and, particularly, to a tool adapted to be driven rapidly.

2. Description of the Related Art

In order to allow a user to use an open end wrench without having to reposition the wrench on an object to be driven after each turn, TW Patent No. M483145 discloses a ratchet type open end wrench. The wrench has a body. The body has a grip and a head connected to the grip. The head has a first jaw and a second jaw for holding an object to be driven. The first jaw has a slot and a pawl is movably engaged in the slot. The pawl is urged by a spring. The pawl is not moved in the slot when the wrench turns the object. The pawl is, however, movable in the slot to a retracted position to allow the wrench to rotate relative to the object.

The wrench has a complicated structure. Thus, it is difficult to make the wrench, and it has a high cost. Further, the pawl is often stuck, especially after a long period of use.

The present invention is, therefore, intended to obviate or at least alleviate the problems encountered in the prior art.

SUMMARY OF THE INVENTION

According to the present invention, a tool adapted to be driven rapidly includes a driving portion which has a first jaw and a second jaw configured to hold an object to be driven therebetween and an opening between the first and the second jaws configured to receive the object to be driven. The first and the second jaws have first and second engaging sides configured to grip the object to be driven. The opening has a closed end, an open end, and two opposite sides respectively delimited by the first and the second engaging sides. The first engaging side extends along a linear line. The second engaging side extends along a curved line. The closed end of the opening has a width smaller than a width of the open end of the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
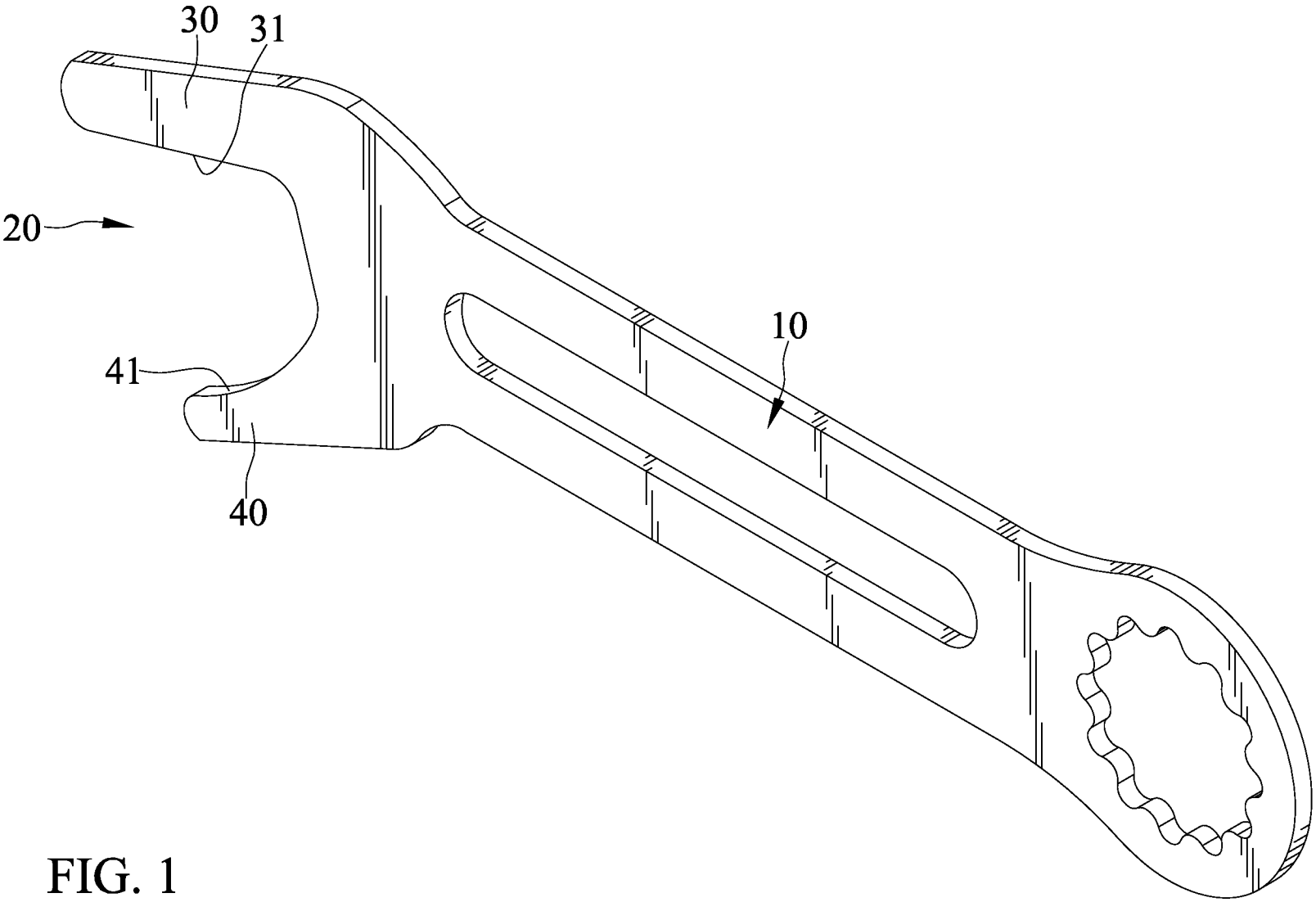
FIG. 1 is a perspective view of a tool adapted to be driven rapidly in accordance with a first embodiment of the present invention.
Figure 2:
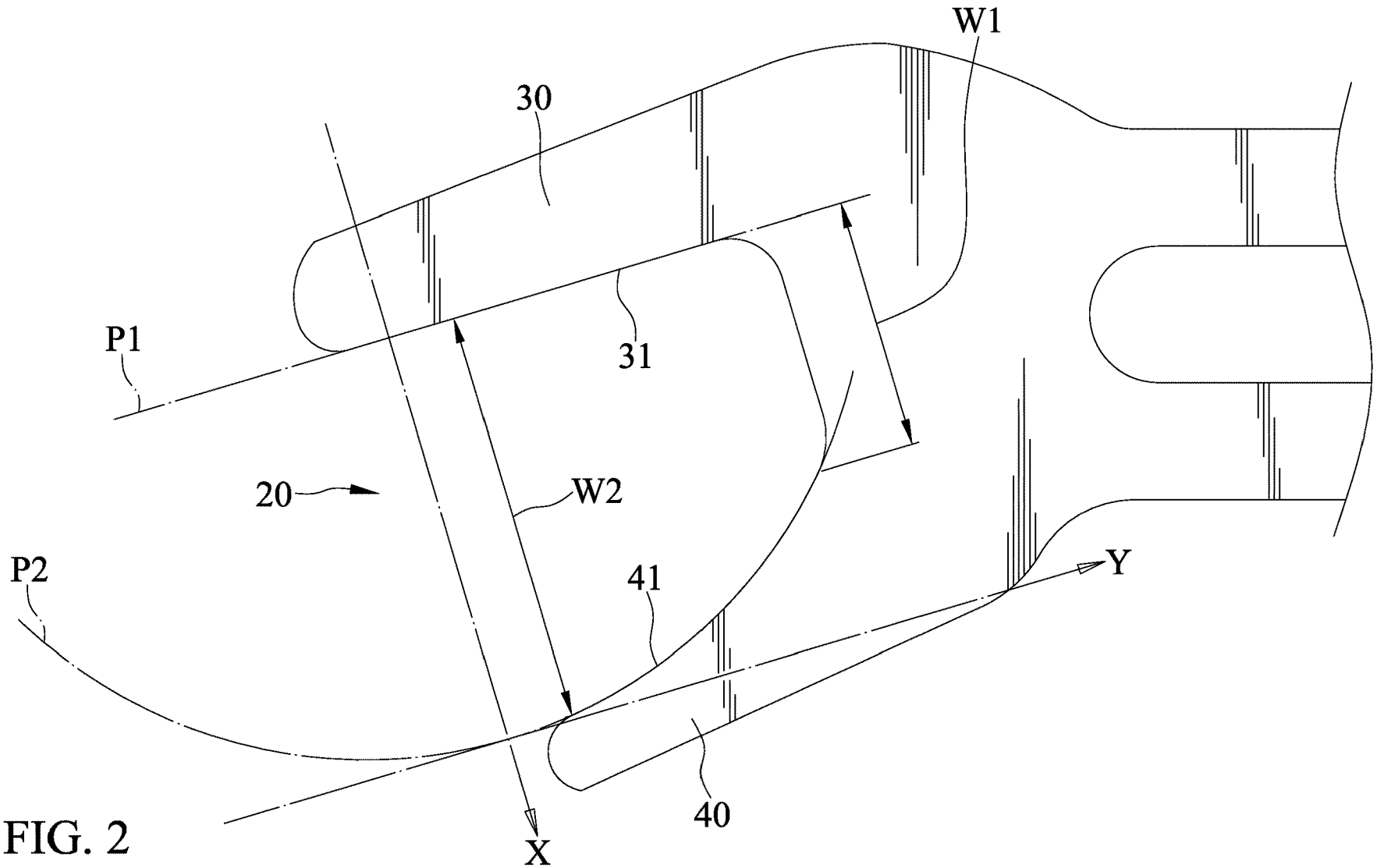
FIG. 2 is an enlarged, side view of a driving portion of the tool of FIG.
Figure 3:
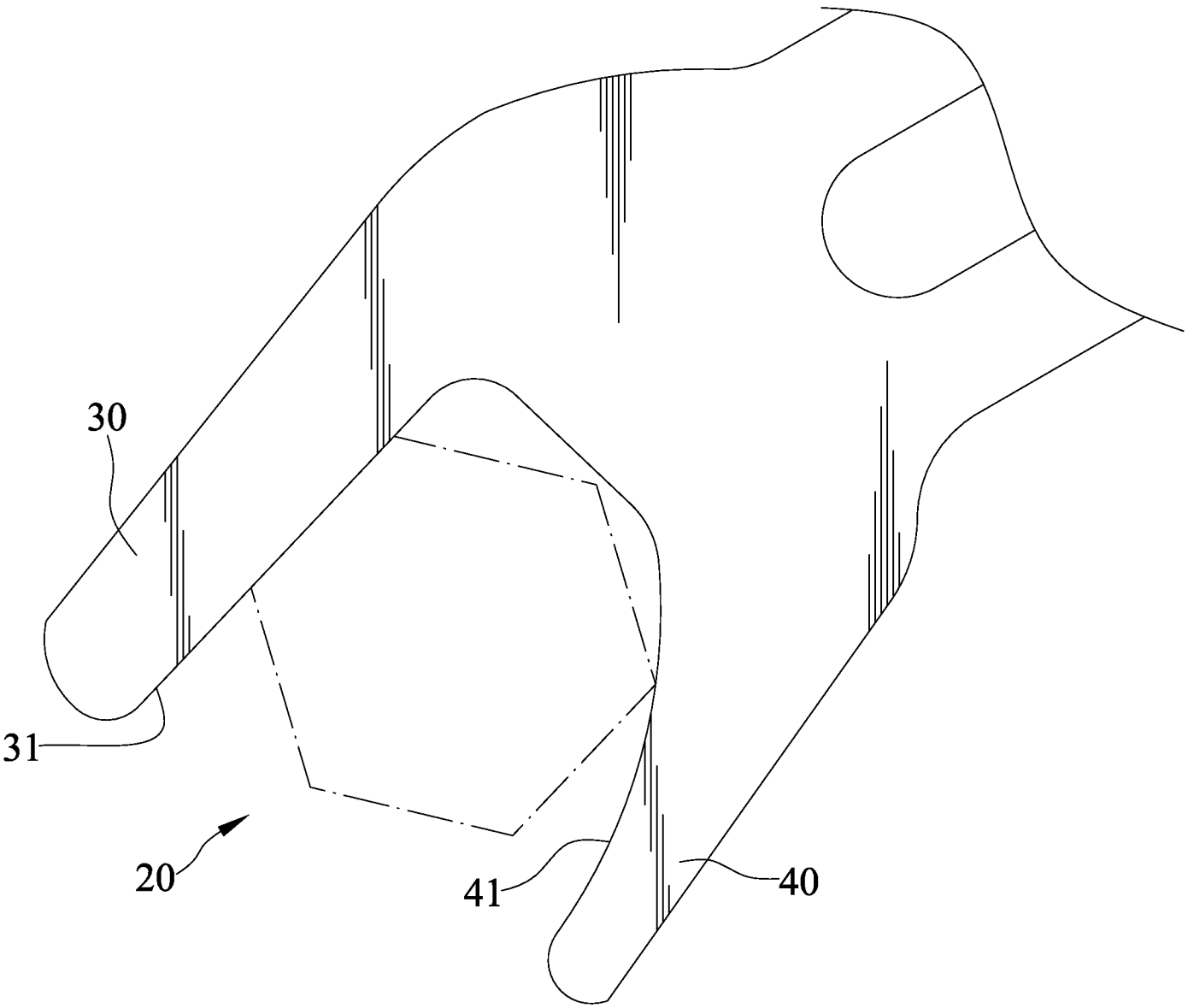
FIG. 3 shows the driving portion of the tool of FIG. 1 engaging with an object to be driven.
Figure 4:
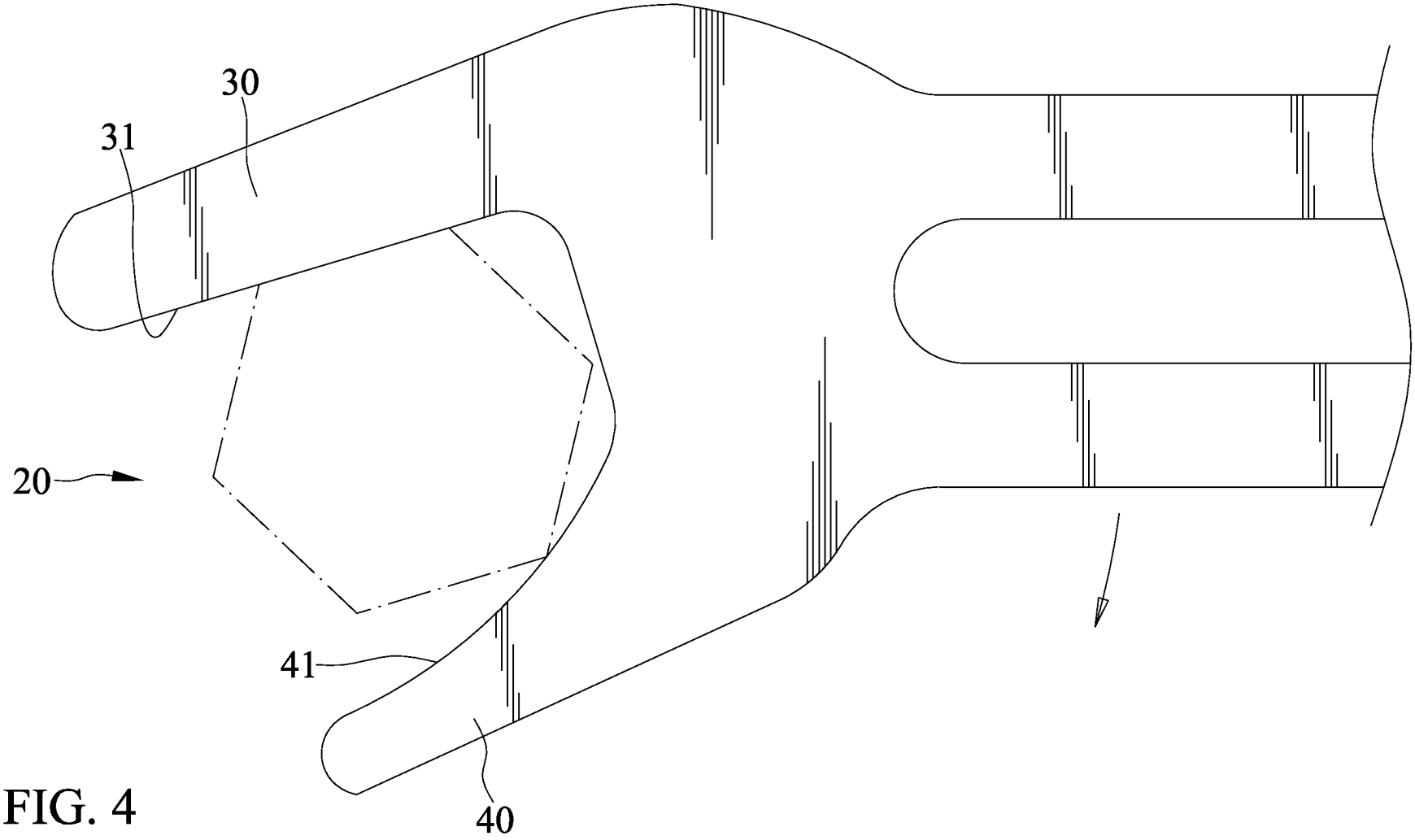
FIG. 4 shows the tool of FIG. 1 driving the object clockwise.
Figure 5:
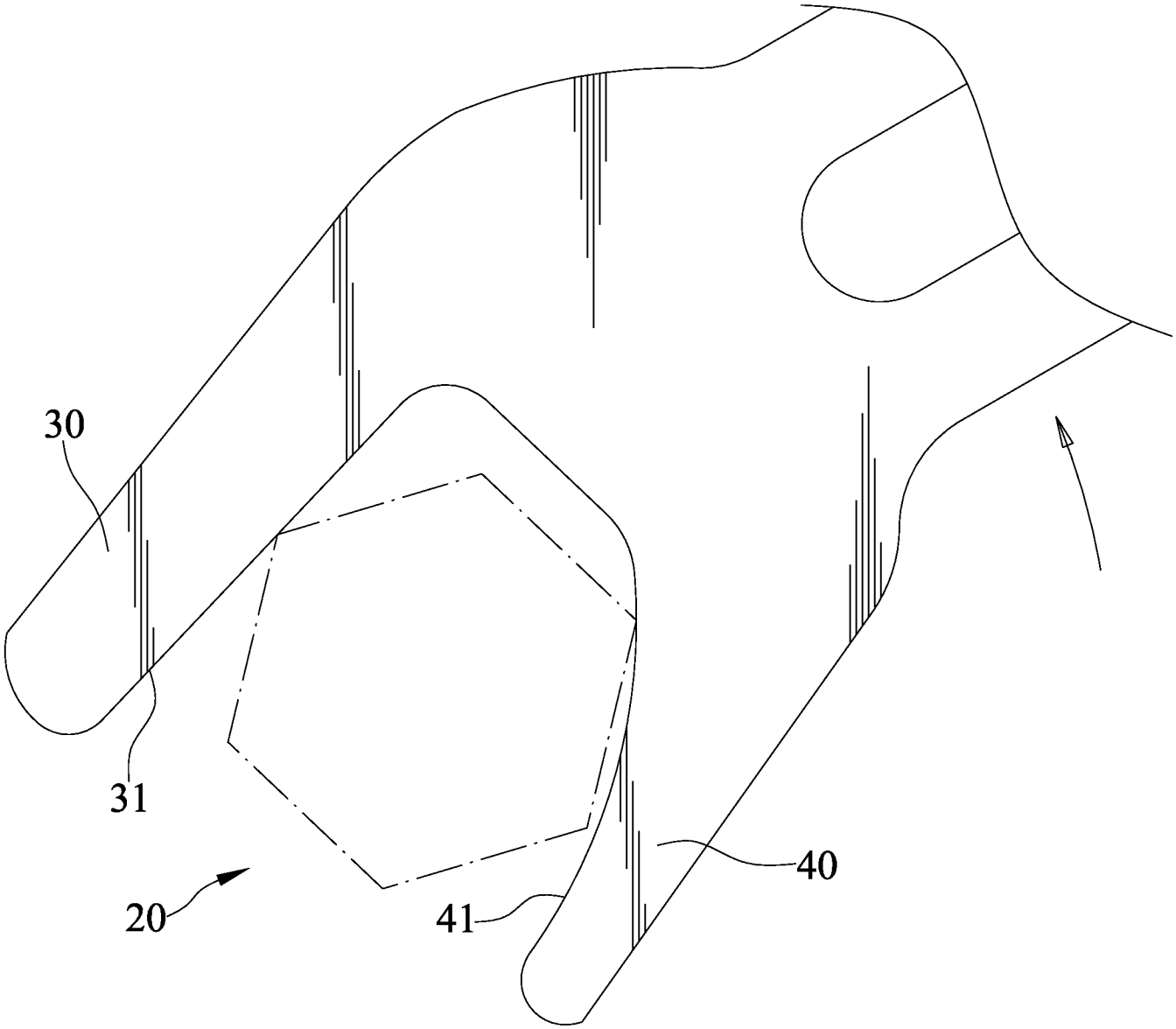
FIG. 5 shows the tool of FIG. 1 driving the object counterclockwise.

FIGS. 1 through 5 show a tool 10 adapted to be driven rapidly in accordance with a first embodiment of the present invention.

The tool 10 has a driving portion. The driving portion has a jaw 30 and a jaw 40 configured to hold an object to be driven therebetween. The driving portion has an opening 20 between the jaws 30 and 40 configured to receive the object to be driven.

The jaws 30 and 40 have engaging sides 31 and 41 configured to grip the object to be driven. The engaging sides 31 and 41 are formed in one piece. The opening 20 has a closed end, an open end, and two opposite sides respectively delimited by the engaging sides 31 and 41. The closed end of the opening 20 has a width smaller than a width of the open end of the opening 20. Each of the engaging sides 31 and 41 has a first end adjacent to the closed end of the opening 20 and a second end adjacent to the open end of the opening 20. The first ends of the engaging sides 31 and 41 are spaced at a first perpendicular distance measuring a width W1. The second ends of the engaging sides 31 and 41 are spaced at a perpendicular distance measuring a width W2. The width W1 is smaller than the width W2.

The engaging side 31 extends along a linear line P1. The engaging side 41 extends along a curved line P2. The engaging side 41 extends along a parabola. The parabola has an axis of symmetry X which is perpendicular to the engaging side 31. The parabola has a vertex on an arbitrary axis Y which is parallel to the engaging side 31. The parabola has an equation:

$$y^2=-12x.$$

The tool 10 can be operated in a first direction to turn relative to the object and a second direction to drive the object. When the tool 10 is used to drive the object, the object is in static with respect to the engaging sides 31 and 41.

Figure 6:
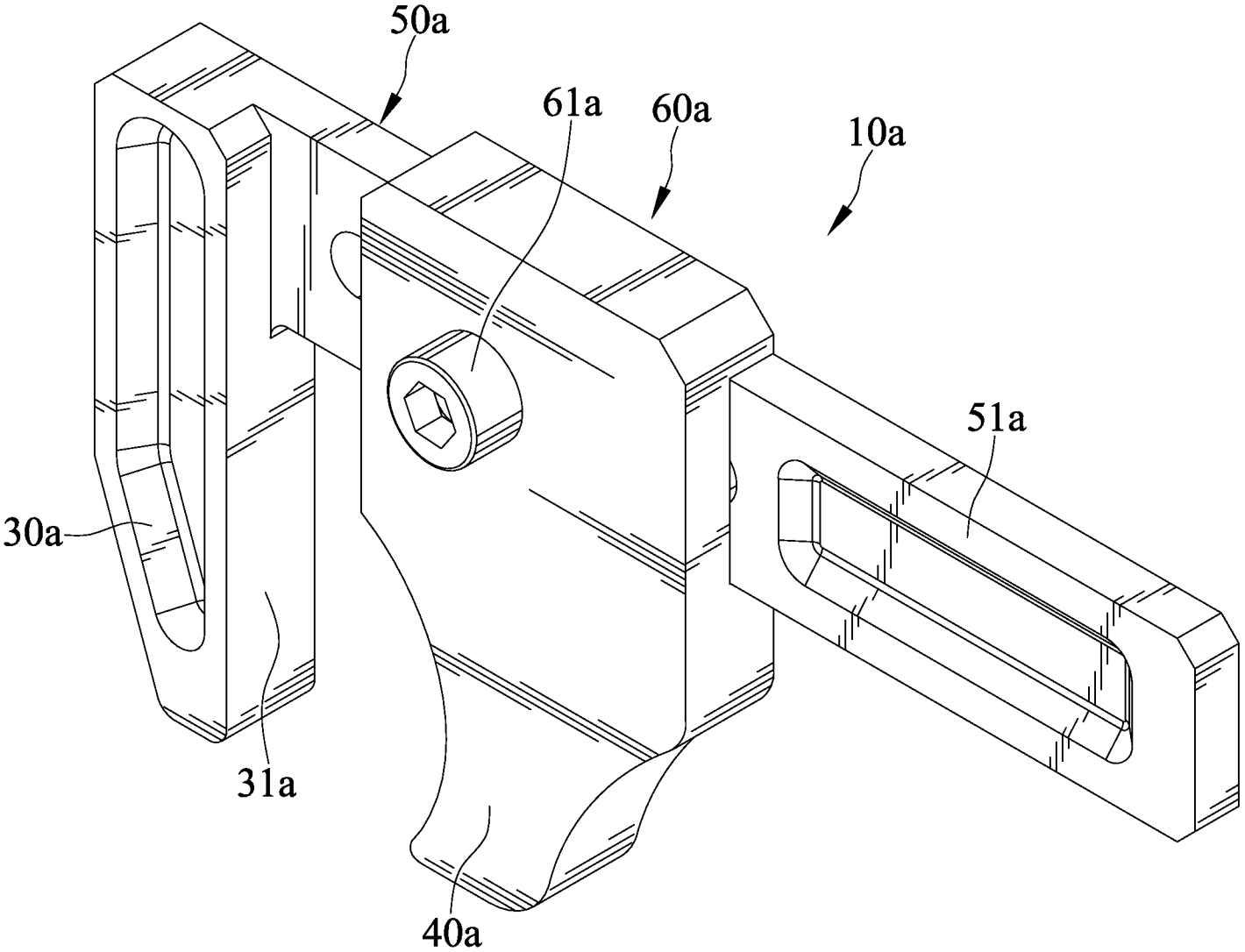
FIG. 6 is a perspective view of a tool adapted to be driven rapidly in accordance with a second embodiment of the present invention.
Figure 7:
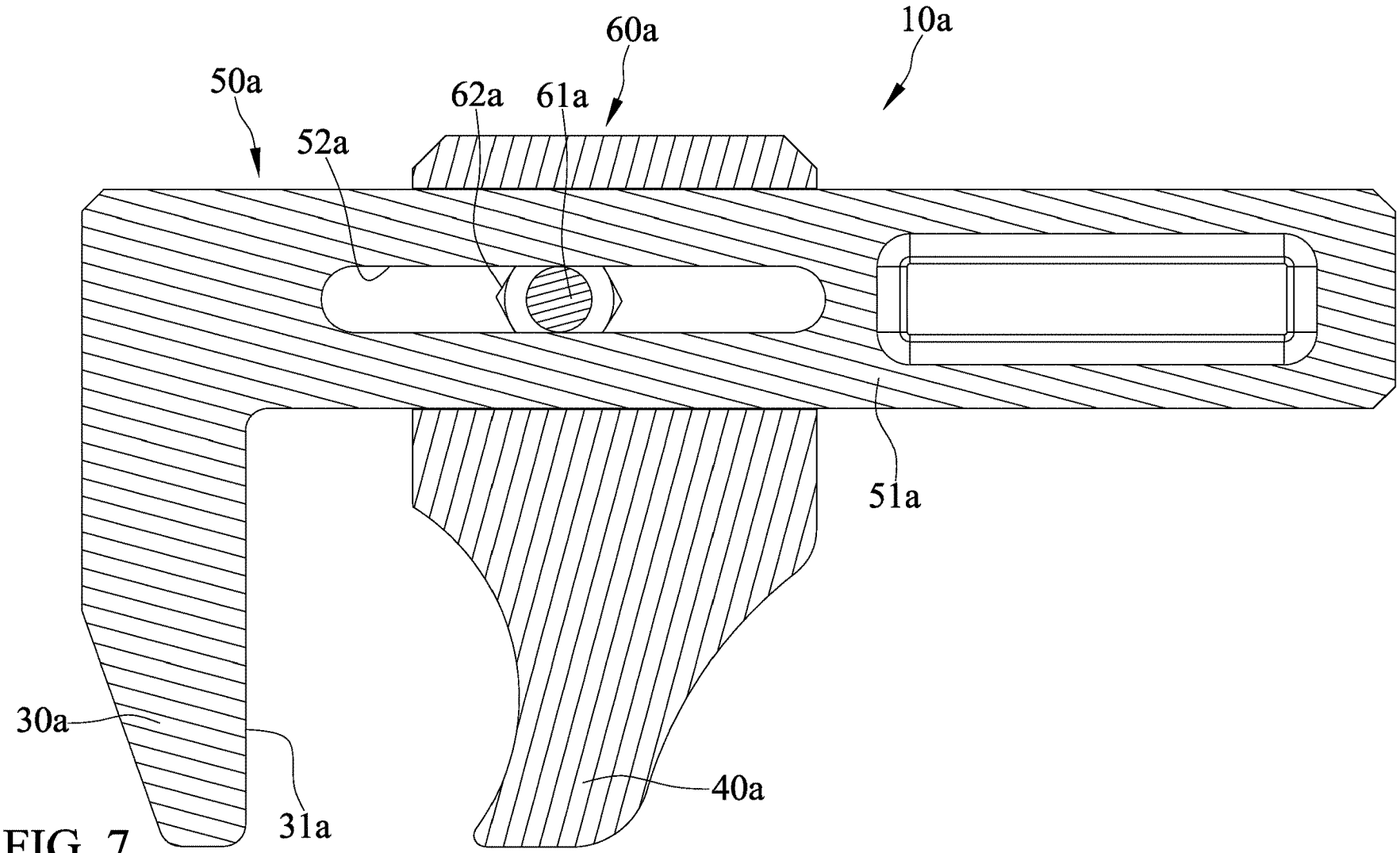
FIG. 7 is a cross-sectional view of the tool of FIG. 6.

FIGS. 6 and 7 show a tool 10*a* in accordance with a second embodiment of the present invention, and the same numbers are used to correlate similar components of the first embodiment, but bearing a letter a. The tool 10*a* has a jaw 30*a* and a jaw 40*a*. An engaging side 31*a* extends linearly. An engaging side of the jaw 40*a* extends curvedly and along a parabola. The tool 10*a* differentiates from the tool 10 in that it has a body 50*a* and a body 60*a* movably coupled to the body 50*a*. The body 50*a* has the jaw 30*a*. The body 60*a* has the jaw 40*a*. The body 60*a* is slidably coupled to the body 50*a* such that the opening varies in size in response to sliding movement of the body 60*a* with respect to the body 50*a*. The body 50*a* has a shank 51*a* and the body 60*a* is slidably coupled to the shank 51*a*. The engaging side 31*a* of the jaw 30*a* has a longitudinal length transverse to a longitudinal length of the shank 51*a*. In this embodiment, the longitudinal length of the engaging side is substantially perpendicular to the longitudinal length of the shank 51*a*.

Further, the body 50*a* defines a groove 52*a* and the body 60*a* has a connecting portion 61*a* movably engaged in the groove 52*a*. The body 60*a* is operably movable between a first position in which the connecting portion 61*a* is disposed adjacent to a first end of the groove 52*a* and the jaws 30*a* and 40*a* are disposed adjacent to each other such that the opening has a first size, and a second position in which the connecting portion 61*a* is disposed adjacent to a second end of the groove 52*a* and the jaws 30*a* and 40*a* are disposed away from each other such that the opening has a second size which is greater than the first size. The connecting portion 61*a* is engaged with a fastener 62*a*. The connecting portion 61*a* is prevented from moving out of the groove 52*a* by the fastener 62*a*. The fastener 62*a* is disposed outside the groove 52*a*.

Figure 8:
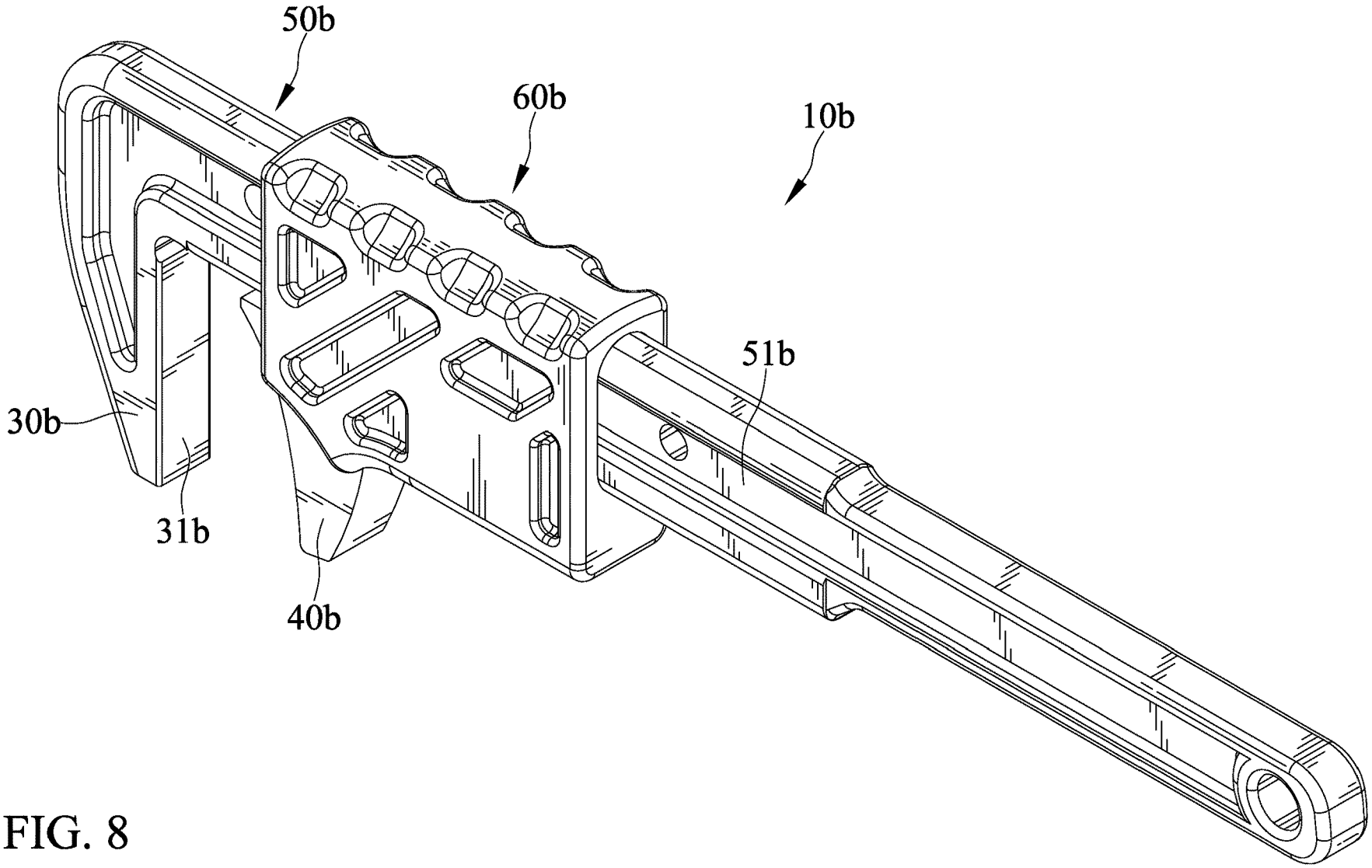
FIG. 8 is a perspective view of a tool adapted to be driven rapidly in accordance with a third embodiment of the present invention.
Figure 9:
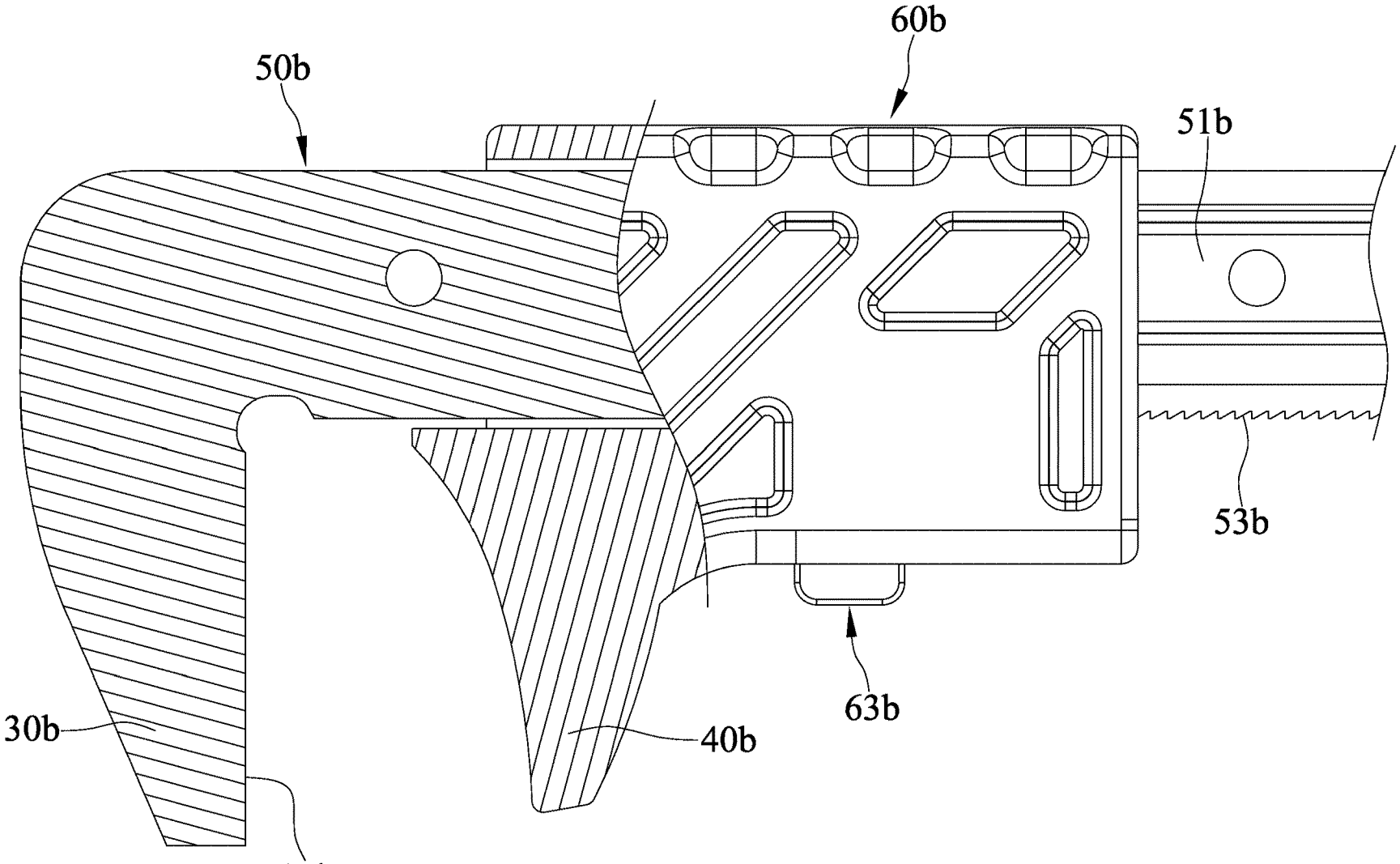
FIG. 9 is a cross-sectional view of the tool of FIG. 8.

FIGS. 8 and 9 show a tool 10*b* in accordance with a third embodiment of the present invention, and the same numbers are used to correlate similar components of the first embodiment, but bearing a letter b. The tool 10*b* has a jaw 30*b* and a jaw 40*b*. An engaging side 31*b* extends linearly. An engaging side of the jaw 40*b* extends curvedly and along a parabola. The tool 10*b* differentiates from the tool 10 in that it has a body 50*b* and a body 60*b* movably coupled to the body 50*b*. The body 50*b* has the jaw 30*b*. The body 60*b* has the jaw 40*b*. The body 60*b* is slidably coupled to the body 50*b* such that the opening varies in size in response to sliding movement of the body 60*b* with respect to the body 50*b*. The body 50*b* has a shank 51*b* and the body 60*b* is slidably coupled to the shank 51*b*.

Further, the body 50*b* has a position retaining portion 53*b* and the body 60*b* includes a catch 63*b* coupled thereto movably engaged with the position retaining portion 53*b*. The catch 63*b* is operably movable between a first position engaging with the position retaining portion 53*b* such that the body 60*b* is unmovably fixed to the body 50*b*, and a second position disengaging form the position retaining portion 53*b* such that the body 60*b* is movably disposed on the body 50*b*. The position retaining portion 53*b* includes a plurality of teeth on which the catch 63*b* is adapted to engage.

Figure 10:
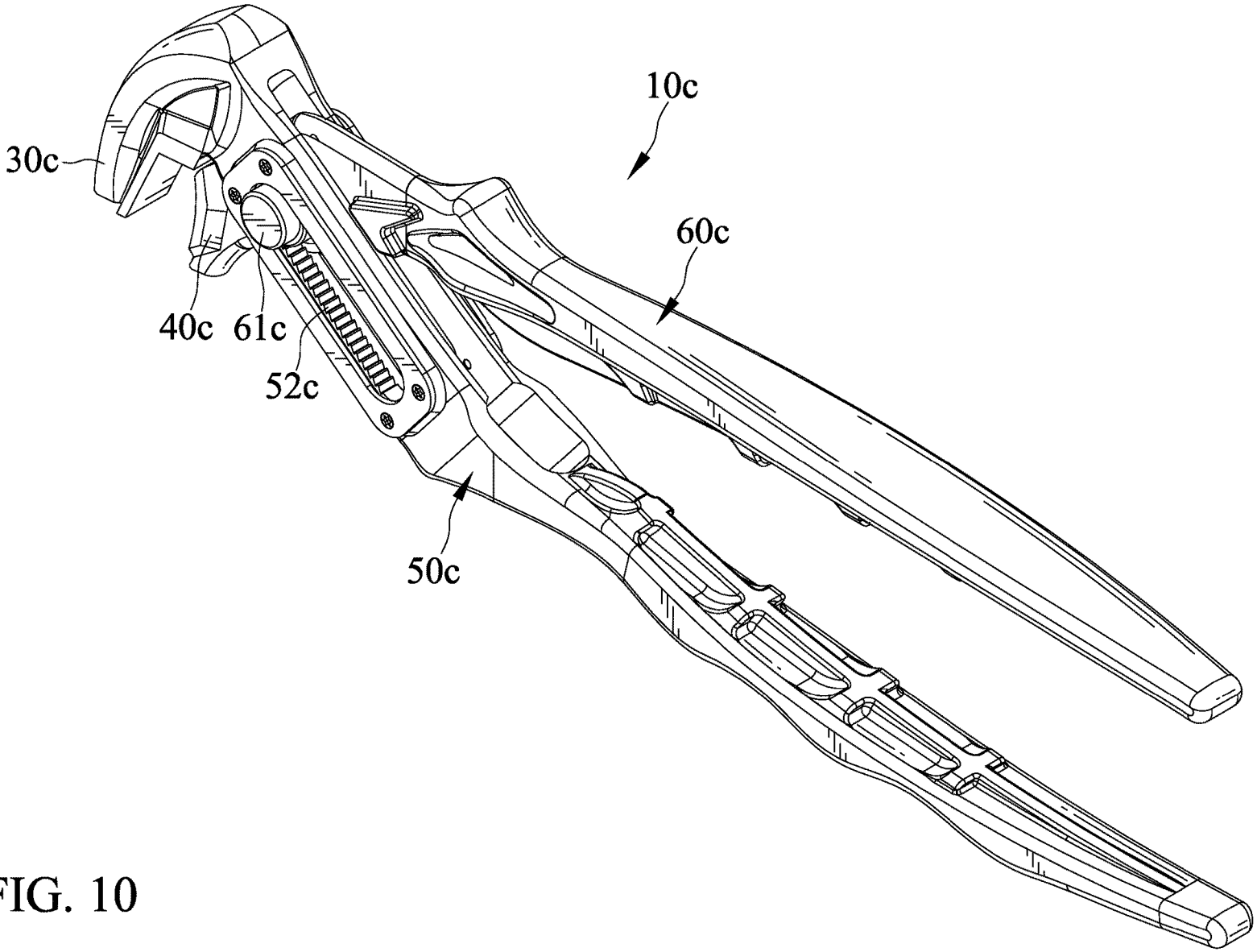
FIG. 10 is a perspective view of a tool adapted to be driven rapidly in accordance with a fourth embodiment of the present invention.
Figure 11:
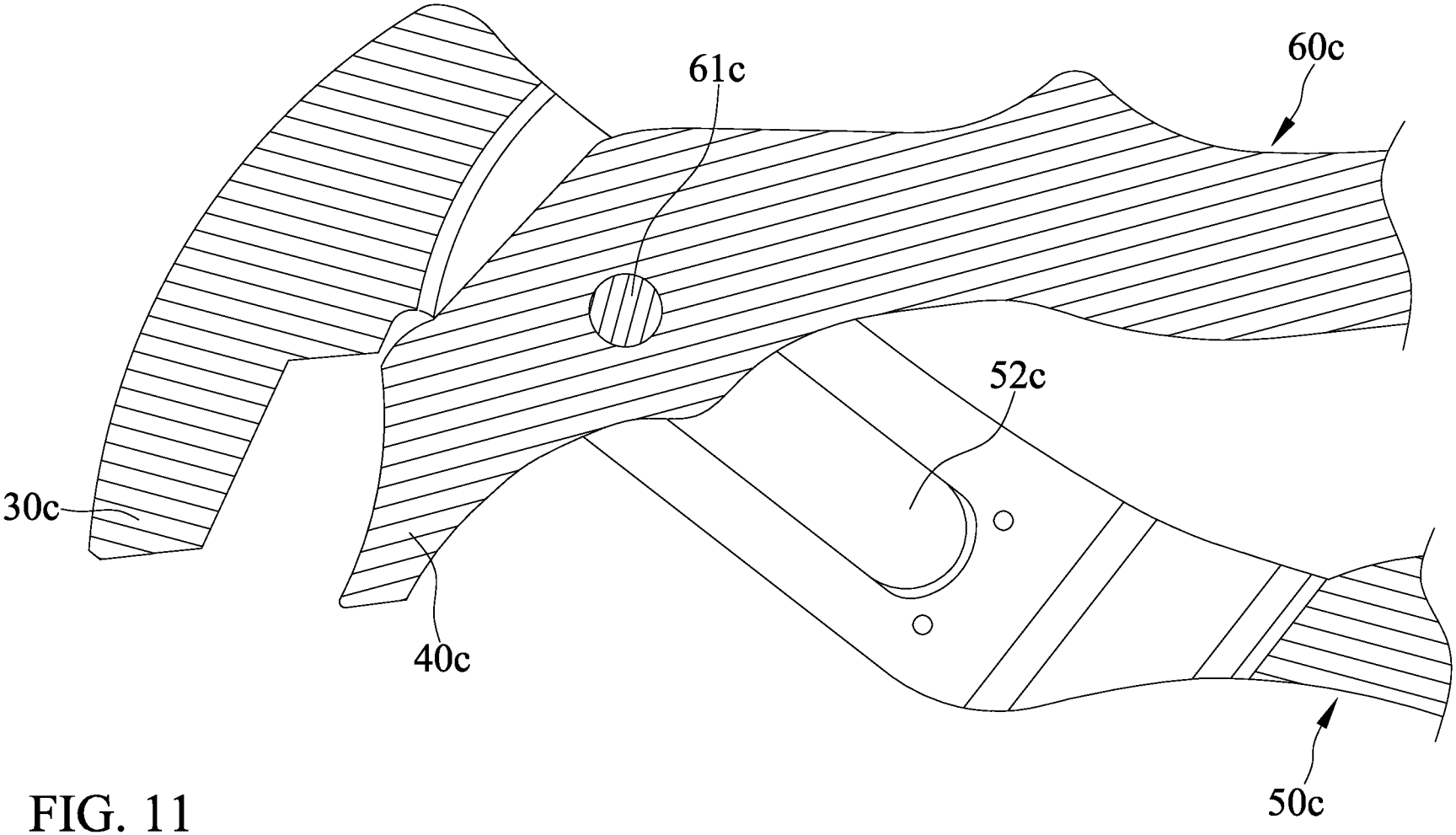
FIG. 11 is a cross-sectional view of the tool of FIG. 10.

FIGS. 10 and 11 show a tool head in accordance with a fourth embodiment of the present invention, and the same numbers are used to correlate similar components of the first embodiment, but bearing a letter c. The tool 10*c* has a jaw 30*c* and a jaw 40*c*. An engaging side of the jaw 30 extends linearly. An engaging side of the jaw 40*c* extends curvedly and along a parabola. The tool 10*c* differentiates from the tool 10 in that it has a body 50*c* and a body 60*c* movably coupled to the body 50*c*. The body 50*c* has the jaw 30*c*. The body 60*b* has the jaw 40*c*. The body 60*c* is pivotally coupled to the first body 50*c* such that the opening varies in size in response to pivoting movement of the second body 60*c* with respect to the first body 50*c*.

Further, the body 50*c* defines a groove 52*c* and the body 60*c* has a connecting portion 61*c* movably engaged in the groove 52*c*. The second body 60*c* is operably movable between a first position in which the connecting portion 61*c* is disposed adjacent to a first end of the groove 52*c* and the jaws 30*c* and 40*c* are disposed adjacent to each other such that the opening has a first size, and a second position in which the connecting portion 61*c* is disposed adjacent to a second end of the groove 52*c* and the jaws 30*c* and 40*c* are disposed away from each other such that the opening has a second size which is greater than the first size.

Figure 12:
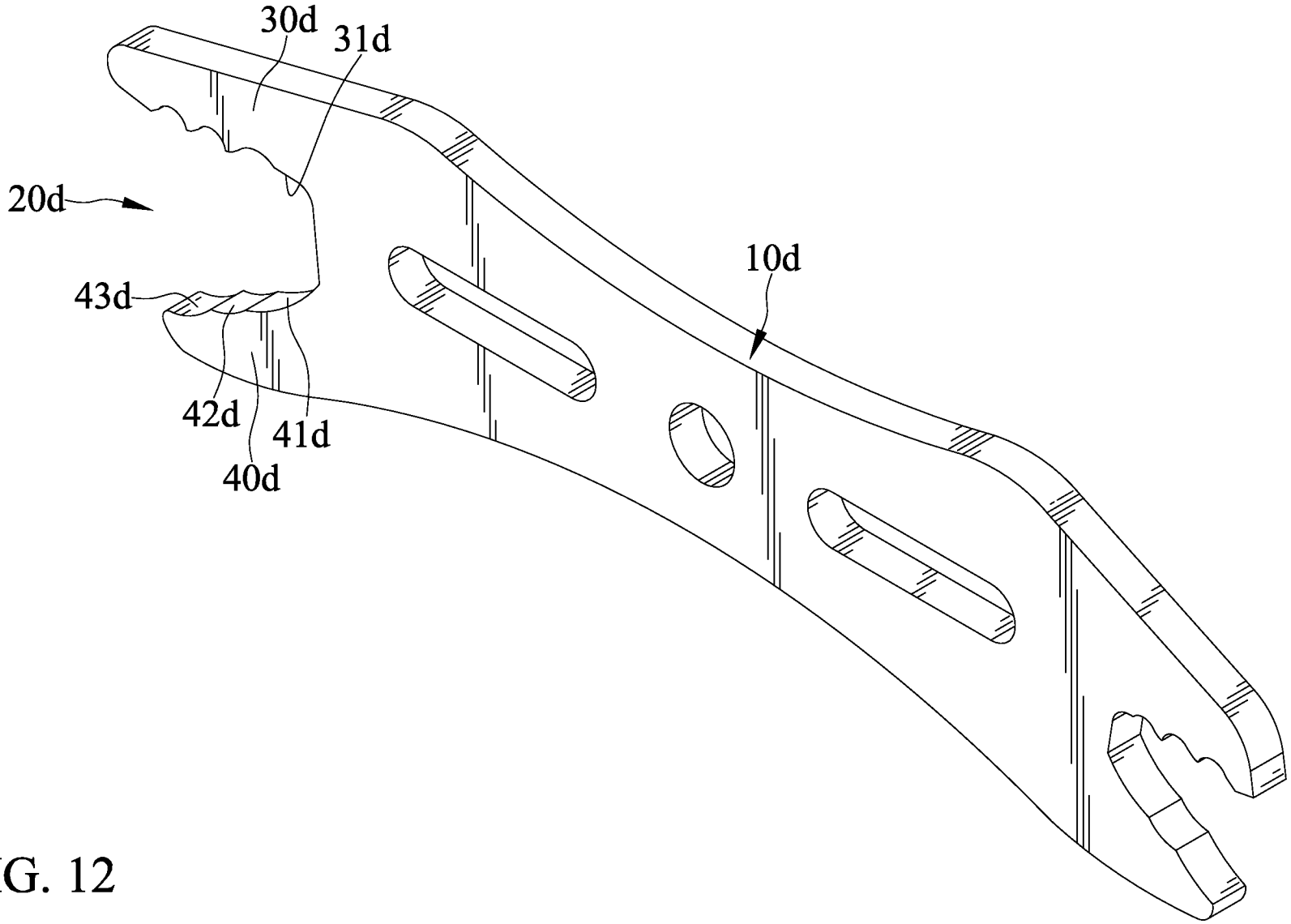
FIG. 12 is a perspective view of a tool adapted to be driven rapidly in accordance with a fifth embodiment of the present invention.
Figure 13:
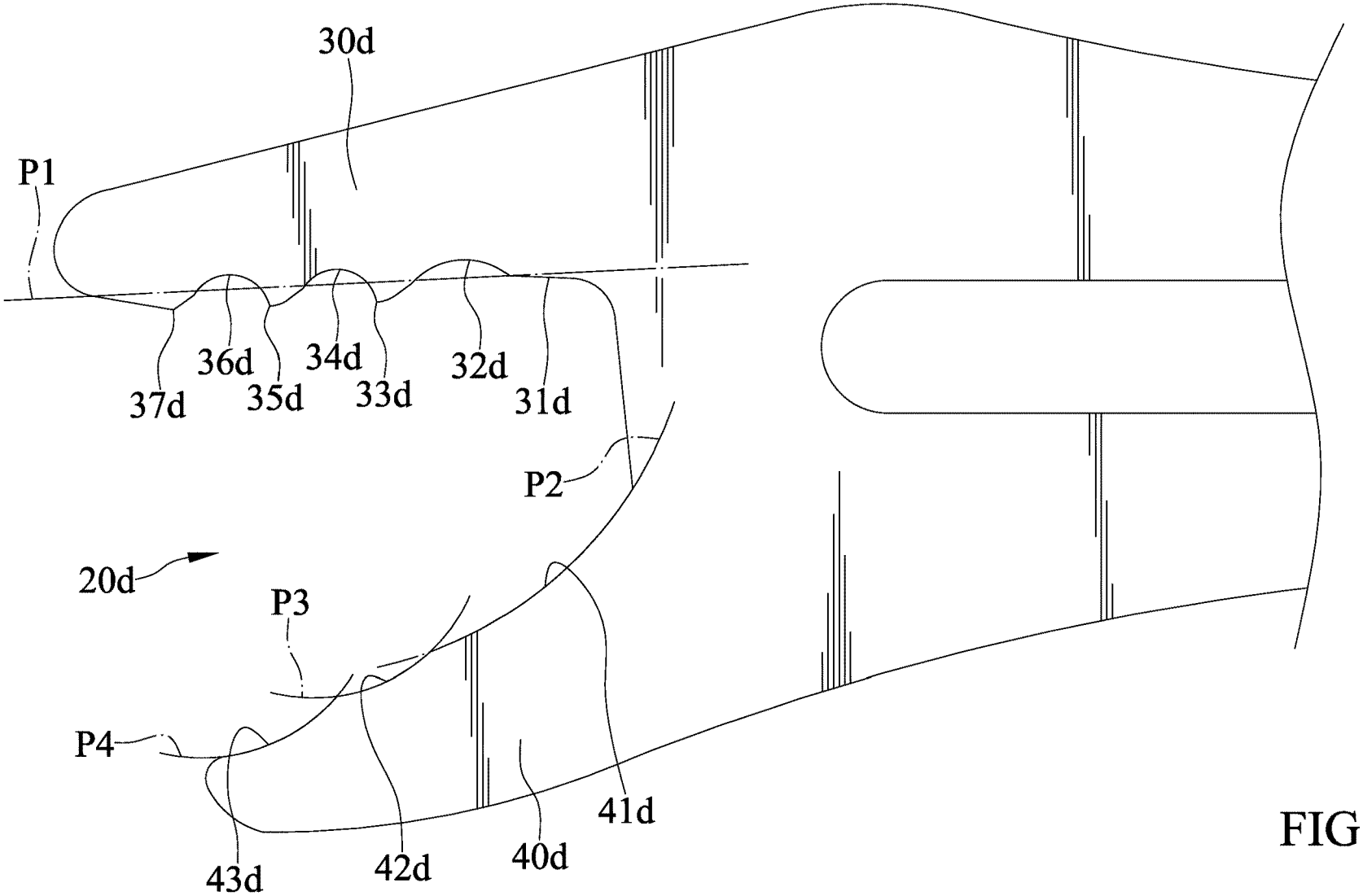
FIG. 13 is an enlarged, side view of a driving portion of the tool of FIG. 12.

FIGS. 12 and 13 show a tool adapted to be driven rapidly in accordance with a fifth embodiment of the present invention, and the same numbers are used to correlate similar components of the first embodiment, but bearing a letter d. The tool 10*d* has an opening 20*d*, a jaw 30*d*, and a jaw 40*d*. An engaging side 31*d* of the jaw 30 extends linearly. An engaging side 41*d* of the jaw 40*d* extends curvedly and along a parabola. The tool 10*d* differentiates from the tool 10 in that the jaw 30*d* further includes protrusions 33*d*, 35*d*, and 37*d* extending therefrom and a jaw 40*d* further includes concavities 42*d* and 43*d*. The protrusions 33*d*, 35*d*, and 37*d* have bases extending along a linear line P1. The protrusions 33*d*, 35*d*, and 37*d* are disposed successively along the linear line P1. The protrusion 33*d* is disposed adjacent to the engaging side 31*d*, which is disposed adjacent to the closed end of the opening 20*d*. The protrusion 37*d* is disposed adjacent to the open end of the opening 20*d*. The engaging side 31*d* and the protrusion 33*d* are separated by a recess 32*d*. The protrusions 33*d* and 35*d* are separated by a recess 34*d*. The protrusions 35*d* and 37*d* are separated by a recess 36*d*. The protrusions 33*d*, 35*d*, and 37*d* have the same height. The concavity 42*d* is disposed between the engaging side 41*d* and the concavity 43*d*. The engaging side 41*d* is disposed adjacent to the closed end of the opening 20*d*. The concavity 42*d* extends along a curved line P3. The concavity 43*d* extends along a curved line P4.

In the embodiment, each of the protrusions 33*d*, 35*d*, and 37*d* has sides configured to abut against the object to be driven, so a user can drive the object with a larger torque.

Figure 14:
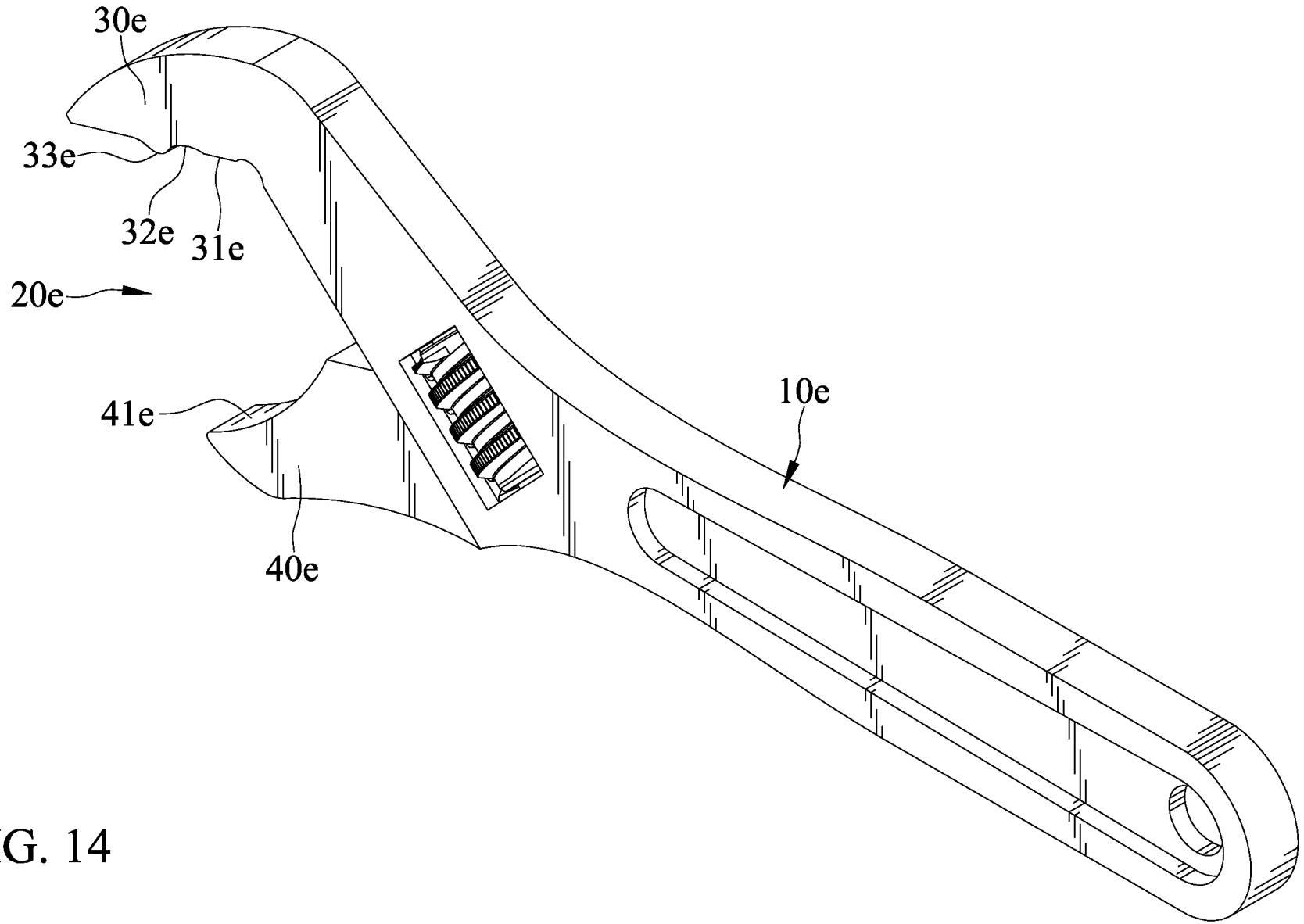
FIG. 14 is a perspective view of a tool adapted to be driven rapidly in accordance with a sixth embodiment of the present invention.
Figure 15:
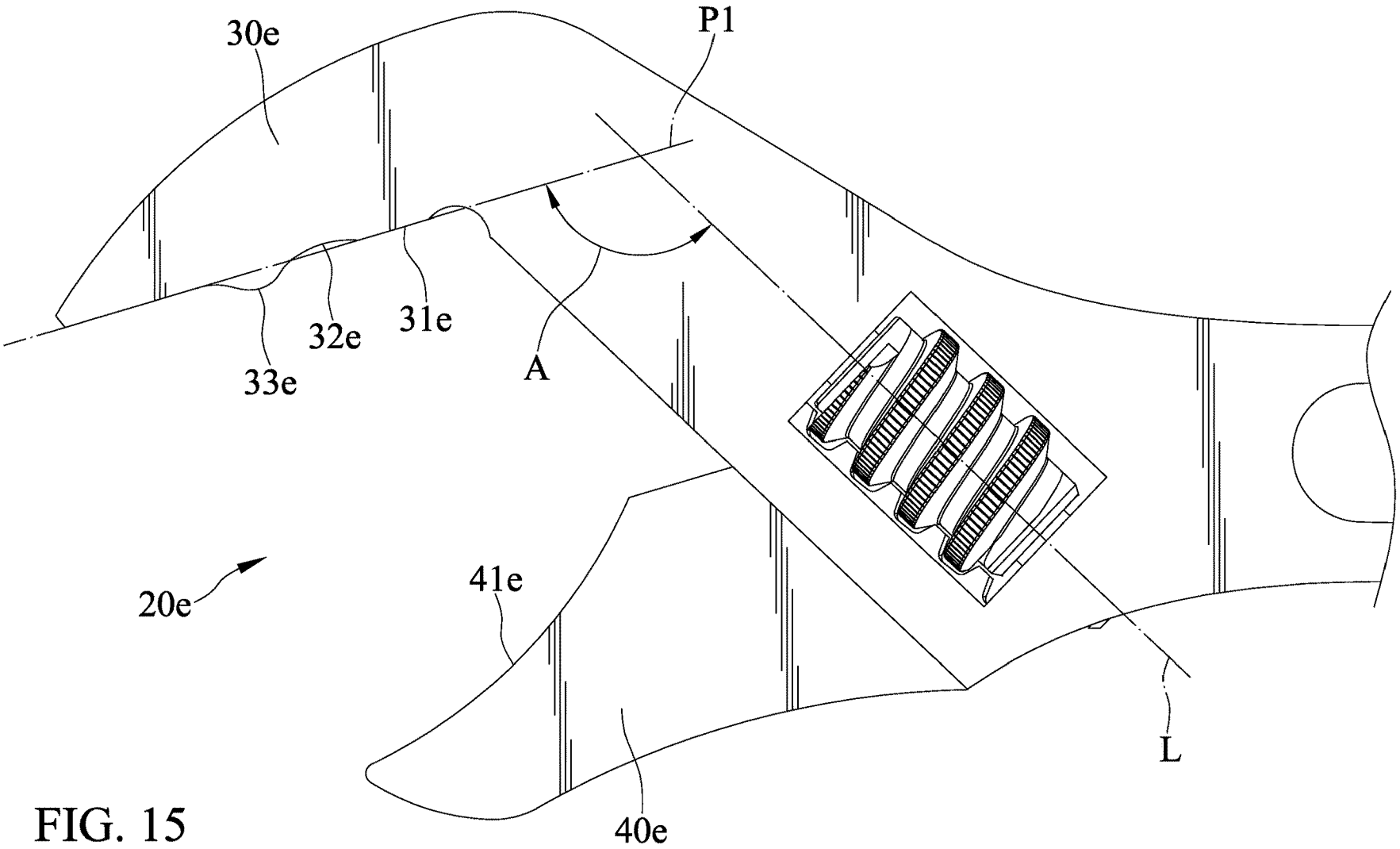
FIG. 15 is an enlarged, side view of a driving portion of the tool of FIG. 14.

FIGS. 14 and 15 show a tool adapted to be driven rapidly in accordance with a sixth embodiment of the present invention, and the same numbers are used to correlate similar components of the first embodiment, but bearing a letter e. The tool 10*e* has an opening 20*e*, a jaw 30*e* with an engaging side 31*e*, and a jaw 40*e* with an engaging side 41*e*. The engaging side 31*d* extends linearly. The engaging side 41*d* extends curvedly and along a parabola. The tool 10*e* differentiates from the tool 10 in that the jaw 30*e* further includes a protrusion 33*e* extending therefrom and a recess 32*e* and the jaw 40*e* is operably movable with respect to the jaw 30*e*. The protrusion 33*e* has a base extending along a linear line P1. The recess 32*e* is disposed between the protrusion 33*d* and the engaging side 31*d*, which is disposed adjacent to the closed end of the opening 20*d*. In the embodiment, the protrusion 33*d* has a side configured to abut against the object to be driven, so a user can drive the object with a larger torque.

In view of the forgoing, the tools 10, 10*a*, 10*b*, 10*c*, 10*d*, and 10*e*, which is adapted to be driven rapidly, include the engaging sides 31, 31*a*, and 31*b* extending along a linear line P1, the engaging sides 41 and 41*e* extending along a curved line P2, and the closed ends of the openings 20, 20*d*, and 20*e* having a width smaller than a width of the open ends of the opening 20, 20*d*, and 20*e*.

The foregoing is merely illustrative of the principles of this invention and various modifications can be made by those skilled in the art without departing from the scope and spirit of the invention.

What is claimed is:

1. A tool adapted to be driven rapidly comprising:

a driving portion having a first jaw and a second jaw configured to hold an object to be driven therebetween and an opening between the first and the second jaws configured to receive the object to be driven, wherein the first and the second laws have first and second engaging sides configured to grip the object to be driven, wherein the opening has a closed end, an open end, and two opposite sides respectively delimited by the first and the second engaging sides, wherein the first engaging side extends along a linear line, wherein the second engaging side extends along a curved line, wherein the closed end of the opening has a width smaller than a width of the open end of the opening, wherein the second engaging side extends along a parabola, wherein the parabola has an equation: $y^2=-12x$, wherein the parabola has an axis of symmetry which is perpendicular to the first engaging side, and wherein the parabola has a vertex on an arbitrary axis which is parallel to the first engaging side.

2. The tool as claimed in claim 1, wherein each of the first and the second engaging sides has a first end adjacent to the closed end of the opening and a second end adjacent to the open end of the opening, and wherein the first ends of the first and the second engaging sides are spaced at a first perpendicular distance measuring a first width, wherein the second ends of the first and the second engaging sides are spaced at a perpendicular distance measuring a second width, and wherein the first width is smaller than the second width.

3. The tool as claimed in claim 1, wherein the first and the second engaging sides are formed in one piece.

4. A tool adapted to be driven rapidly comprising:

a driving portion having a first jaw and a second jaw configured to hold an object to be driven therebetween and an opening between the first and the second laws configured to receive the object to be driven, wherein the first and the second laws have first and second engaging sides configured to grip the object to be driven, wherein the opening has a closed end, an open end, and two opposite sides respectively delimited by the first and the second engaging sides, wherein the first engaging side extends along a linear line, wherein the second engaging side extends along a curved line, and wherein the closed end of the opening has a width smaller than a width of the open end of the opening;

wherein the driving portion has a first body and a second body movably coupled to the first body, wherein the first body has a jaw forming the first jaw, wherein the second body has a law forming the second law, wherein the second body is slidably coupled to the first body such that the opening varies in size in response to sliding movement of the second body with respect to the first body, wherein the first body has a position retaining portion and the second body includes a catch coupled thereto movably engaged with the position retaining portion, and wherein the catch is operably movable between a first position engaging with the position retaining portion such that the second body is unmovably fixed to the first body, and a second position disengaging form the position retaining portion such that the second body is movably disposed on the first body.

5. The tool as claimed in claim 4, wherein the second body is pivotally coupled to the first body such that the opening varies in size in response to pivoting movement of the second body with respect to the first body.

6. The tool as claimed in claim 5, wherein the first body defines a groove and the second body has a connecting portion movably engaged in the groove, wherein the second body is operably movable between a first position in which the connecting portion is disposed adjacent to a first end of the groove and the first and the second jaws are disposed adjacent to each other such that the opening has a first size, and a second position in which the connecting portion is disposed adjacent to a second end of the groove and the first and the second jaws are disposed away from each other such that the opening has a second size which is greater than the first size.

7. The tool as claimed in claim 4, wherein the first body defines a groove and the second body has a connecting portion movably engaged in the groove, wherein the second body is operably movable between a first position in which the connecting portion is disposed adjacent to a first end of the groove and the first and the second jaws are disposed adjacent to each other such that the opening has a first size, and a second position in which the connecting portion is disposed adjacent to a second end of the groove and the first and the second jaws are disposed away from each other such that the opening has a second size which is greater than the first size.

8. The tool as claimed in claim 4, wherein the position retaining portion includes a plurality of teeth on which the catch is adapted to engage.

9. A tool adapted to be driven rapidly comprising:

a driving portion having a first jaw and a second jaw configured to hold an object to be driven therebetween and an opening between the first and the second jaws configured to receive the object to be driven, wherein the first and the second laws have first and second engaging sides configured to grip the object to be driven, wherein the opening has a closed end, an open end, and two opposite sides respectively delimited by the first and the second engaging sides, wherein the first engaging side extends along a linear line, wherein the second engaging side extends along a curved line, wherein the closed end of the opening has a width smaller than a width of the open end of the opening, wherein the first jaw includes at least one protrusion extending therefrom, and wherein the protrusion has a base extending along the linear line.

10. The tool as claimed in claim 9, wherein the first jaw includes at least one recess, and wherein the recess is disposed between the at least one protrusion and the engaging side.

11. A tool adapted to be driven rapidly comprising:

a driving portion having a first law and a second law configured to hold an object to be driven therebetween and an opening between the first and the second laws configured to receive the object to be driven, wherein the first and the second jaws have first and second engaging sides configured to grip the object to be driven, wherein the opening has a closed end, an open end, and two opposite sides respectively delimited by the first and the second engaging sides, wherein the first engaging side extends along a linear line, wherein the second engaging side extends along a curved line, wherein the closed end of the opening has a width smaller than a width of the open end of the opening, wherein the first jaw includes protrusions extending therefrom, wherein the second jaw includes concavities, wherein the protrusions have bases extending along the linear line P1, wherein the protrusions are disposed successively along the linear line, wherein one of the protrusions is disposed adjacent to the closed end of the opening, wherein one of the protrusions is disposed adjacent to the open end of the opening.

12. The tool as claimed in claim 11, wherein the first engaging side and the protrusion adjacent thereto include a recess disposed therebetween, and wherein two adjacent protrusion includes a recess disposed therebetween.

13. The tool as claimed in claim 12, wherein the protrusions have the same height.

* * * * *